US009747851B2

(12) United States Patent
Zhang et al.

(10) Patent No.: US 9,747,851 B2
(45) Date of Patent: Aug. 29, 2017

(54) COMPENSATION METHOD OF MURA PHENOMENON

(71) Applicants: Shenzhen China Star Optoelectronics Technology Co., Ltd., Shenzhen (CN); Wuhan China Star Optoelectronics Technology Co., Ltd., Wuhan (CN)

(72) Inventors: Xiaoning Zhang, Shenzhen (CN); Zhentao Tu, Shenzhen (CN); Zhihu Liang, Shenzhen (CN); Hengjie Wang, Shenzhen (CN); Taijiun Hwang, Shenzhen (CN); Pengfei Liang, Shenzhen (CN); Limin Wang, Shenzhen (CN)

(73) Assignees: SHENZHEN CHINA STAR OPTOELECTRONICS TECHNOLOGY CO., LTD., Shenzhen, Guangdong (CN); WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 175 days.

(21) Appl. No.: 14/892,204

(22) PCT Filed: Oct. 28, 2015

(86) PCT No.: PCT/CN2015/093072

§ 371 (c)(1),
(2) Date: Nov. 19, 2015

(87) PCT Pub. No.: WO2017/063230

PCT Pub. Date: Apr. 20, 2017

(65) Prior Publication Data

US 2017/0193933 A1 Jul. 6, 2017

(30) Foreign Application Priority Data

Oct. 16, 2015 (CN) ..... 2015 1 0677609

(51) Int. Cl.
*G09G 5/00* (2006.01)
*G09G 3/36* (2006.01)

(52) U.S. Cl.
CPC ..... *G09G 3/3611* (2013.01); *G09G 3/3666* (2013.01); *G09G 3/36* (2013.01)

(58) Field of Classification Search
CPC ..... G09G 3/3611; G09G 3/3666; G09G 3/36
See application file for complete search history.

(56) References Cited

U.S. PATENT DOCUMENTS 7,893,897 B2 * 2/2011 Chung ..... G09G 3/2011 315/169.3
8,743,215 B1 * 6/2014 Lee ..... G09G 3/006 348/180

(Continued)

*Primary Examiner* — Towfiq Elahi
(74) *Attorney, Agent, or Firm* — Leong C. Lei

(57) ABSTRACT

The present invention provides a compensation method of Mura phenomenon. By dividing the LCD display panel into a plurality of display partitions, and selecting a pre-selected pixel dot of a determined position in each display partition and obtaining gray scale compensation data thereof at the respectively selected gray scales, and then, calculating the respective interpolation coefficients of the requested pixel dots in the corresponding display partitions, the compensation data of partial pixel dots in the respective gray scales and the respective interpolation coefficients of the requested pixel dots can be utilized to calculate the gray scale compensation data of all pixel dots in all gray scales. The calculation difficulty is reduced to lower the computation. The consumption of the hardware storage space is decreased and the Mura compensation result can be ensured. The time and effort can be saved and it can be simple and quick.

15 Claims, 6 Drawing Sheets

(56) References Cited

U.S. PATENT DOCUMENTS

| | | | | |
|---|---|---|---|---|
| 9,013,384 | B2 * | 4/2015 | Al-Dahle | G09G 3/3611 345/87 |
| 2006/0061828 | A1 * | 3/2006 | Park | G09G 3/3611 358/300 |
| 2007/0132895 | A1 * | 6/2007 | Shen | G09G 3/2007 349/1 |
| 2007/0182441 | A1 * | 8/2007 | Hwang | G09G 3/3648 345/204 |
| 2010/0013751 | A1 * | 1/2010 | Kerofsky | G09G 3/006 345/89 |
| 2011/0285873 | A1 * | 11/2011 | Showering | G06K 9/228 348/231.99 |
| 2013/0044816 | A1 * | 2/2013 | Amano | H04N 19/182 375/240.16 |
| 2015/0070403 | A1 * | 3/2015 | Kim | G09G 3/3607 345/690 |
| 2015/0213326 | A1 * | 7/2015 | Utsumi | G06K 9/6212 348/223.1 |
| 2016/0043104 | A1 * | 2/2016 | Li | G02F 1/134363 257/773 |
| 2016/0247432 | A1 * | 8/2016 | Hu | G09G 3/20 |

* cited by examiner

| | first column | second column | third column | fourth column | fifth column | sixth column | seventh column | eighth column |
|---|---|---|---|---|---|---|---|---|
| A1 | 8/8 | 7/8 | 6/8 | 5/8 | 4/8 | 3/8 | 2/8 | 1/8 |
| A2 | 0/8 | 1/8 | 2/8 | 3/8 | 4/8 | 5/8 | 6/8 | 7/8 |

Fig. 5

| | first row | second row | third row | fourth row | fifth row | sixth row | seventh row | eighth row |
|---|---|---|---|---|---|---|---|---|
| B1 | 8/8 | 7/8 | 6/8 | 5/8 | 4/8 | 3/8 | 2/8 | 1/8 |
| B2 | 0/8 | 1/8 | 2/8 | 3/8 | 4/8 | 5/8 | 6/8 | 7/8 |

Fig. 6

| inputted gray scale data signal | | C1 | | C2=10, 000, 000−C1 |
|---|---|---|---|---|
| 0 | | 0 | integer bit | 0 |
| 0 | | 0 | decimal bit | 1 |
| 1 | | 1 | | 0 |
| 0 | | 0 | | 1 |
| 1 | | 1 | | 0 |
| 0 | | 1 | | 1 |
| 1 | | 0 | filled with 0 | 0 |
| 1 | | 0 | | 0 |

COMPENSATION METHOD OF MURA PHENOMENON

FIELD OF THE INVENTION

The present invention relates to a display technology field, and more particularly to a compensation method of Mura phenomenon.

BACKGROUND OF THE INVENTION

The LCD (Liquid Crystal Display) possesses many advantages of being ultra thin, power saved and radiation free, and quickly becomes the major product in the present market. It has been widely utilized in, such as LCD TVs, mobile phones, Personal Digital Assistant (PDA), digital cameras, laptop screens or notebook screens, and dominates the flat panel display field.

In the development direction of the LCD display for being lighter, thinner, bigger, some uncontrollable factors in the practical processes result in that there are difference among the physical properties of respective positions of the LCD display panel. Thus, in an area larger than one pixel dot, the uneven brightness phenomenon as showing pure gray scale pictures is so called the Mura phenomenon in the industry.

The Mura phenomenon has already become the bottle neck restricting the development of LCD. By raising the art level or promoting purity of the row materials, the occurrence probability of the Mura phenomenon can be reduced. For the LCD display panel of which the manufacture process is accomplished, the physical properties are determined. Then, the gray scale compensation can be employed to calibrate the brightness of the pixel dot to improve the Mura phenomenon.

The gray scale compensation is to change the gray scale value of the pixel to achieve the improvement to the brightness uniformity: as showing the pure gray scale pictures, a lower gray scale value is applied to the pixel of which the display brightness is higher, and a higher gray scale value is applied to the pixel of which the display brightness is lower. Then, the brightnesses of the respective pixels after the gray scale compensation are closely consistent to achieve the improvement to the Mura phenomenon.

The technologies of compensating the Mura phenomenon according to prior art generally requires calculation and compensation to data of every gray scale respectively for all pixel dots of the entire screen of the LCD display panel. The amount of data is huge and the demand to the hardware storage space is higher.

With the increasing dimension of the LCD display panel, the present compensation skill to the Mura phenomenon will take more time and effort. Thus, there is a need to improve the compensation method of Mura phenomenon.

SUMMARY OF THE INVENTION

An objective of the present invention is to provides a compensation method of Mura phenomenon, which can solve the issue that the compensation data of every gray scale of all pixel dots have to be calculated to waste time and effort when calibrating the existing Mura phenomenon of the LCD display panel according to prior art. The calculation difficulty is reduced to lower the computation. The consumption of the hardware storage space is decreased and the Mura compensation result can be ensured. The time and effort can be saved and it can be simple and quick.

For realizing the aforesaid objectives, the present invention provides a compensation method of Mura phenomenon, comprising steps of:

step 1, providing a LCD display panel, and the LCD display panel is divided into a plurality of display partitions arranged in array, and both M, N are integers larger than 1, and each display partition comprises M rows, N columns pixel dots, and a border position of the LCD display panel having less than M×N pixel dots is considered to be a border display partition;

step 2, selecting k gray scales including a 0 gray scale and a maximum gray scale, and k is an integer, and the 0 to the maximum gray scales are divided into (k−1) gray scale sections; selecting a pre-selected pixel dot of a determined position of mth row, nth column in each display partition comprising M rows, N columns pixel dots, wherein $1 \le m \le M$, $1 \le n \le N$ and obtaining gray scale compensation data of the pre-selected pixel dot at k gray scales;

step 3, calculating a first horizontal interpolation coefficient A1, a second horizontal interpolation coefficient A2, a first vertical interpolation coefficient B1, a second vertical interpolation coefficient B2, a first gray scale interpolation coefficient C1 and a second gray scale interpolation coefficient C2 of a requested pixel dot in a corresponding display partition;

step 4, employing a formula (1) to calculate a gray scale compensation data d of a gray scale of the requested pixel dot in a non-border display partition according to gray scale compensation data of four pre-selected pixel dots around and closest to a position of the requested pixel dot:

$$d = C1\times(B1\times(d1\times A1+d2\times A2)+B2\times(d3\times A1+d4\times A2))+ C2\times(B1\times(d5\times A1+d6\times A2)+B2\times(d7\times A1+d8\times A2)) \quad (1)$$

wherein d1 and d5 are gray scale compensation data of two border gray scales in the gray scale section of the gray scale of the request pixel dot, in which the pre-selected pixel dot of a top left corner of a rectangle constructed by the four pre-selected pixel dots around and closest to the position of the requested pixel dot is, and d2 and d6 are gray scale compensation data of two border gray scales in the gray scale section of the gray scale of the request pixel dot, in which the pre-selected pixel dot of a top right corner of a rectangle constructed by the four pre-selected pixel dots around and closest to the position of the requested pixel dot is, and d3 and d7 are gray scale compensation data of two border gray scales in the gray scale section of the gray scale of the request pixel dot, in which the pre-selected pixel dot of a bottom left corner of a rectangle constructed by the four pre-selected pixel dots around and closest to the position of the requested pixel dot is, and d4 and d8 are gray scale compensation data of two border gray scales in the gray scale section of the gray scale of the request pixel dot, in which the pre-selected pixel dot of a bottom right corner of a rectangle constructed by the four pre-selected pixel dots around and closest to the position of the requested pixel dot is.

The compensation method of Mura phenomenon further comprises: step 5, a pixel dot of mth row, nth column or closest to mth row, nth column is selected to be the pre-selected pixel dot in each border display partition, and with known gray scale compensation data of K gray scales of the pre-selected pixel dots in each border display partition, the formula (2) is employed to calculate the gray scale compensation data of any gray scales, at which the pre-selected pixel dot is in each border display partition, and gray scale compensation data of other pixel dots and the gray scale compensation data of the pre-selected pixel dot in the corresponding border display partition are the same;

$$d=d1\times C1+d2\times C2 \quad (2)$$

wherein d1 is gray scale compensation data of a right border of a gray scale section, in which a requested gray scale of the pre-selected pixel dot, and d2 is gray scale compensation data of a left border of the gray scale section, in which the requested gray scale of the pre-selected pixel dot; the first gray scale interpolation coefficient C1 is a ratio of a difference value of the requested gray scale and the right border of the gray scale section and a length of an entire gray scale section, and the second gray scale interpolation coefficient C2 is a ratio of a difference value of the requested gray scale and the left border of the gray scale section and the length of the entire gray scale section.

In the step 3:

$0\leq A1\leq 1$, $0\leq A2\leq 1$; and $A1+A2=1$ for the same requested pixel dot; in one display partition comprising M rows, N columns pixel dots, for starting from a column where the pre-selected pixel dot is in the display partition to the right in sequence, and reaching a right border of the display partition and turning to a left border, and keeping to the right until reaching a column adjacent to the column where the pre-selected pixel dot is at the left side in sequence, the first horizontal gray scale interpolation coefficients A1 of the requested pixel dots of respective columns sequentially are N/N, N−1/N, . . . , 1/N, and the second horizontal gray scale interpolation coefficients A2 sequentially are 0/N, 1 /N, . . . , N−1/N;

$0\leq B1\leq 1$, $0\leq B2\leq 1$; and $B1+B2=1$ for the same requested pixel dot; in one display partition comprising M rows, N columns pixel dots, for starting from a row where the pre-selected pixel dot is in the display partition to the bottom in sequence, and reaching a bottom border of the display partition and turning to a top border, and keeping to the bottom until reaching a row adjacent to the column where the pre-selected pixel dot is at the top side in sequence, the first vertical interpolation coefficient B1 of the requested pixel dots of respective rows sequentially are M/M, M−1/M, . . . , 1/M, and the second vertical interpolation coefficient B2 sequentially are 0/M, 1/M, . . . , M−1/M;

according to comparison of the grays scale compensation data of the requested pixel dot and the known K gray scales, the gray scale section of the gray scale of the request pixel dot is obtained; $0\leq C1\leq 1$, $0\leq C2\leq 1$; and $C1+C2=1$ for the same requested pixel dot; the first gray scale interpolation coefficient C1 is a ratio of a difference value of the gray scale of the requested pixel dot and the right border of the gray scale section and a length of an entire gray scale section, and the second gray scale interpolation coefficient C2 is a ratio of a difference value of the gray scale of the requested pixel dot and the left border of the gray scale section and the length of the entire gray scale section.

In the step 4, the four pre-selected pixel dots around and closest to the position of the requested pixel dot respectively are the pre-selected pixel dot in the display partition where the requested pixel is, the pre-selected pixel dot in the display partition at the right and adjacent to the display partition where the requested pixel is, the pre-selected pixel dot in the display partition at the bottom and adjacent to the display partition where the requested pixel is and the pre-selected pixel dot in the display partition at the bottom right corner and adjacent to the display partition where the requested pixel is.

In the step 2, the pre-selected pixel dot of the determined position of first row, first column is selected in each display partition comprising M rows, N columns pixel dots; in the step 5, the pixel dot of first row, first column is selected to be the pre-selected pixel dot in each border display partition.

Four memorizers provided in the step 2 respectively are a first memorizer, a second memorizer, a third memorizer and a fourth memorizer, and for the array comprising a plurality of pre-selected pixel dots aligned in array, the first memorizer is employed to store the gray scale compensation data of the pre-selected pixel dots of odd row, odd column at K gray scales, and the second memorizer is employed to store the gray scale compensation data of the pre-selected pixel dots of odd row, even column at K gray scales, and the third memorizer is employed to store the gray scale compensation data of the pre-selected pixel dots of even row, odd column at K gray scales, and the fourth memorizer is employed to store the gray scale compensation data of the pre-selected pixel dots of even row, even column at K gray scales.

The maximum gray scale in the step 2 is 255 gray scale.

As the requested pixel dot is the pre-selected pixel dot, the gray scale compensation data d of the pre-selected pixel dot at any gray scales is calculated according to formula (2):

$$d=d1\times C1+d2\times C2 \quad (2)$$

wherein d1 is gray scale compensation data of a right border of a gray scale section, in which a requested gray scale of the pre-selected pixel dot, and d2 is gray scale compensation data of a left border of the gray scale section, in which the requested gray scale of the pre-selected pixel dot; the first gray scale interpolation coefficient C1 is a ratio of a difference value of the requested gray scale and the right border of the gray scale section and a length of an entire gray scale section, and the second gray scale interpolation coefficient C2 is a ratio of a difference value of the requested gray scale and the left border of the gray scale section and the length of the entire gray scale section.

As the gray scale, at which the requested pixel dot is, is the one of the K gray scales, the gray scale compensation data d of the gray scale, at which the requested pixel dot is, is calculated by formula (3):

$$d=(d1\times A1+d2\times A2)\times B1+(d3\times A1+d4\times A2)\times B2 \quad (3)$$

d1 is gray scale compensation data of the gray scale of the request pixel dot, in which the pre-selected pixel dot of a top left corner of a rectangle constructed by the four pre-selected pixel dots around and closest to the position of the requested pixel dot is, and d2 is gray scale compensation data of the gray scale of the request pixel dot, in which the pre-selected pixel dot of a top right corner of a rectangle constructed by the four pre-selected pixel dots around and closest to the position of the requested pixel dot is, and d3 is gray scale compensation data of the gray scale of the request pixel dot, in which the pre-selected pixel dot of a bottom left corner of a rectangle constructed by the four pre-selected pixel dots around and closest to the position of the requested pixel dot is, and d4 is gray scale compensation data of the gray scale of the request pixel dot, in which the pre-selected pixel dot of a bottom right corner of a rectangle constructed by the four pre-selected pixel dots around and closest to the position of the requested pixel dot is.

The present invention further provides a compensation method of Mura phenomenon, comprising steps of:

step 1, providing a LCD display panel, and the LCD display panel is divided into a plurality of display partitions arranged in array, and both M, N are integers larger than 1, and each display partition comprises M rows, N columns pixel dots, and a border position of the LCD display panel having less than M×N pixel dots is considered to be a border display partition;

step 2, selecting k gray scales including a 0 gray scale and a maximum gray scale, and k is an integer, and the 0 to the maximum gray scales are divided into (k−1) gray scale sections; selecting a pre-selected pixel dot of a determined position of mth row, nth column in each display partition comprising M rows, N columns pixel dots, wherein 1≤m≤M, 1≤n≤N, and obtaining gray scale compensation data of the pre-selected pixel dot at k gray scales;

step 3, calculating a first horizontal interpolation coefficient A1, a second horizontal interpolation coefficient A2, a first vertical interpolation coefficient B1, a second vertical interpolation coefficient B2, a first gray scale interpolation coefficient C1 and a second gray scale interpolation coefficient C2 of a requested pixel dot in a corresponding display partition;

step 4, employing a formula (1) to calculate a gray scale compensation data d of a gray scale of the requested pixel dot in a non-border display partition according to gray scale compensation data of four pre-selected pixel dots around and closest to a position of the requested pixel dot:

$$d=C1\times(B1\times(d1\times A1+d2\times A2)+B2\times(d3\times A1+d4\times A2))+C2\times(B1\times(d5\times A1+d6\times A2)+B2\times(d7\times A1+d8\times A2)) \quad (1)$$

wherein d1 and d5 are gray scale compensation data of two border gray scales in the gray scale section of the gray scale of the request pixel dot, in which the pre-selected pixel dot of a top left corner of a rectangle constructed by the four pre-selected pixel dots around and closest to the position of the requested pixel dot is, and d2 and d6 are gray scale compensation data of two border gray scales in the gray scale section of the gray scale of the request pixel dot, in which the pre-selected pixel dot of a top right corner of a rectangle constructed by the four pre-selected pixel dots around and closest to the position of the requested pixel dot is, and d3 and d7 are gray scale compensation data of two border gray scales in the gray scale section of the gray scale of the request pixel dot, in which the pre-selected pixel dot of a bottom left corner of a rectangle constructed by the four pre-selected pixel dots around and closest to the position of the requested pixel dot is, and d4 and d8 are gray scale compensation data of two border gray scales in the gray scale section of the gray scale of the request pixel dot, in which the pre-selected pixel dot of a bottom right corner of a rectangle constructed by the four pre-selected pixel dots around and closest to the position of the requested pixel dot is;

The compensation method further comprises: step 5, a pixel dot of mth row, nth column or closest to mth row, nth column is selected to be the pre-selected pixel dot in each border display partition, and with known gray scale compensation data of K gray scales of the pre-selected pixel dots in each border display partition, the formula (2) is employed to calculate the gray scale compensation data of any gray scales, at which the pre-selected pixel dot is in each border display partition, and gray scale compensation data of other pixel dots and the gray scale compensation data of the pre-selected pixel dot in the corresponding border display partition are the same;

$$d=d1\times C1+d2\times C2 \quad (2)$$

wherein d1 is gray scale compensation data of a right border of a gray scale section, in which a requested gray scale of the pre-selected pixel dot, and d2 is gray scale compensation data of a left border of the gray scale section, in which the requested gray scale of the pre-selected pixel dot; the first gray scale interpolation coefficient C1 is a ratio of a difference value of the requested gray scale and the right border of the gray scale section and a length of an entire gray scale section, and the second gray scale interpolation coefficient C2 is a ratio of a difference value of the requested gray scale and the left border of the gray scale section and the length of the entire gray scale section;

wherein in the step 3:

0≤A1≤1, 0≤A2≤1; and A1+A2=1 for the same requested pixel dot; in one display partition comprising M rows, N columns pixel dots, for starting from a column where the pre-selected pixel dot is in the display partition to the right in sequence, and reaching a right border of the display partition and turning to a left border, and keeping to the right until reaching a column adjacent to the column where the pre-selected pixel dot is at the left side in sequence, the first horizontal gray scale interpolation coefficients A1 of the requested pixel dots of respective columns sequentially are N/N, N−1/N, . . . , 1/N, and the second horizontal gray scale interpolation coefficients A2 sequentially are 0/N, 1/N, . . . , N−1/N;

0≤B1≤1, 0≤B2≤1; and B1+B2=1 for the same requested pixel dot; in one display partition comprising M rows, N columns pixel dots, for starting from a row where the pre-selected pixel dot is in the display partition to the bottom in sequence, and reaching a bottom border of the display partition and turning to a top border, and keeping to the bottom until reaching a row adjacent to the column where the pre-selected pixel dot is at the top side in sequence, the first vertical interpolation coefficient B1 of the requested pixel dots of respective rows sequentially are M/M, M−1/M, . . . , 1/M, and the second vertical interpolation coefficient B2 sequentially are 0/M, 1/M, . . . , M−1/M;

according to comparison of the grays scale compensation data of the requested pixel dot and the known K gray scales, the gray scale section of the gray scale of the request pixel dot is obtained; 0≤C1≤1, 0≤C2≤1; and C1+C2=1 for the same requested pixel dot; the first gray scale interpolation coefficient C1 is a ratio of a difference value of the gray scale of the requested pixel dot and the right border of the gray scale section and a length of an entire gray scale section, and the second gray scale interpolation coefficient C2 is a ratio of a difference value of the gray scale of the requested pixel dot and the left border of the gray scale section and the length of the entire gray scale section;

wherein in the step 4, the four pre-selected pixel dots around and closest to the position of the requested pixel dot respectively are the pre-selected pixel dot in the display partition where the requested pixel is, the pre-selected pixel dot in the display partition at the right and adjacent to the display partition where the requested pixel is, the pre-selected pixel dot in the display partition at the bottom and adjacent to the display partition where the requested pixel is and the pre-selected pixel dot in the display partition at the bottom right corner and adjacent to the display partition where the requested pixel is.

The benefits of the present invention are: the present invention provides a compensation method of Mura phenomenon. By dividing the LCD display panel into a plurality of display partitions, and selecting a pre-selected pixel dot of a determined position in each display partition and obtaining gray scale compensation data thereof at the respectively selected gray scales, and then, calculating the respective interpolation coefficients of the requested pixel dots in the corresponding display partitions, the compensation data of partial pixel dots in the respective gray scales and the respective interpolation coefficients of the requested pixel dots can be utilized to calculate the gray scale compensation data of all pixel dots in all gray scales. The calculation difficulty is reduced to lower the computation. The consumption of the hardware storage space is decreased and the Mura compensation result can be ensured. The time and effort can be saved and it can be simple and quick.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings,

FIG. 5 is a value table of the first horizontal interpolation coefficient A1 and the second horizontal interpolation coefficient A2 corresponding to the requested pixel dots of respective columns from left to right in the display partition shown in FIG. 4;

FIG. 6 is a value table of the first vertical interpolation coefficient B1 and the second vertical interpolation coefficient B2 corresponding to the requested pixel dots of respective rows from top to bottom in the display partition shown in FIG. 4;

DETAILED DESCRIPTION OF PREFERRED EMBODIMENTS

For better explaining the technical solution and the effect of the present invention, the present invention will be further described in detail with the accompanying drawings and the specific embodiments.

Figure 1:
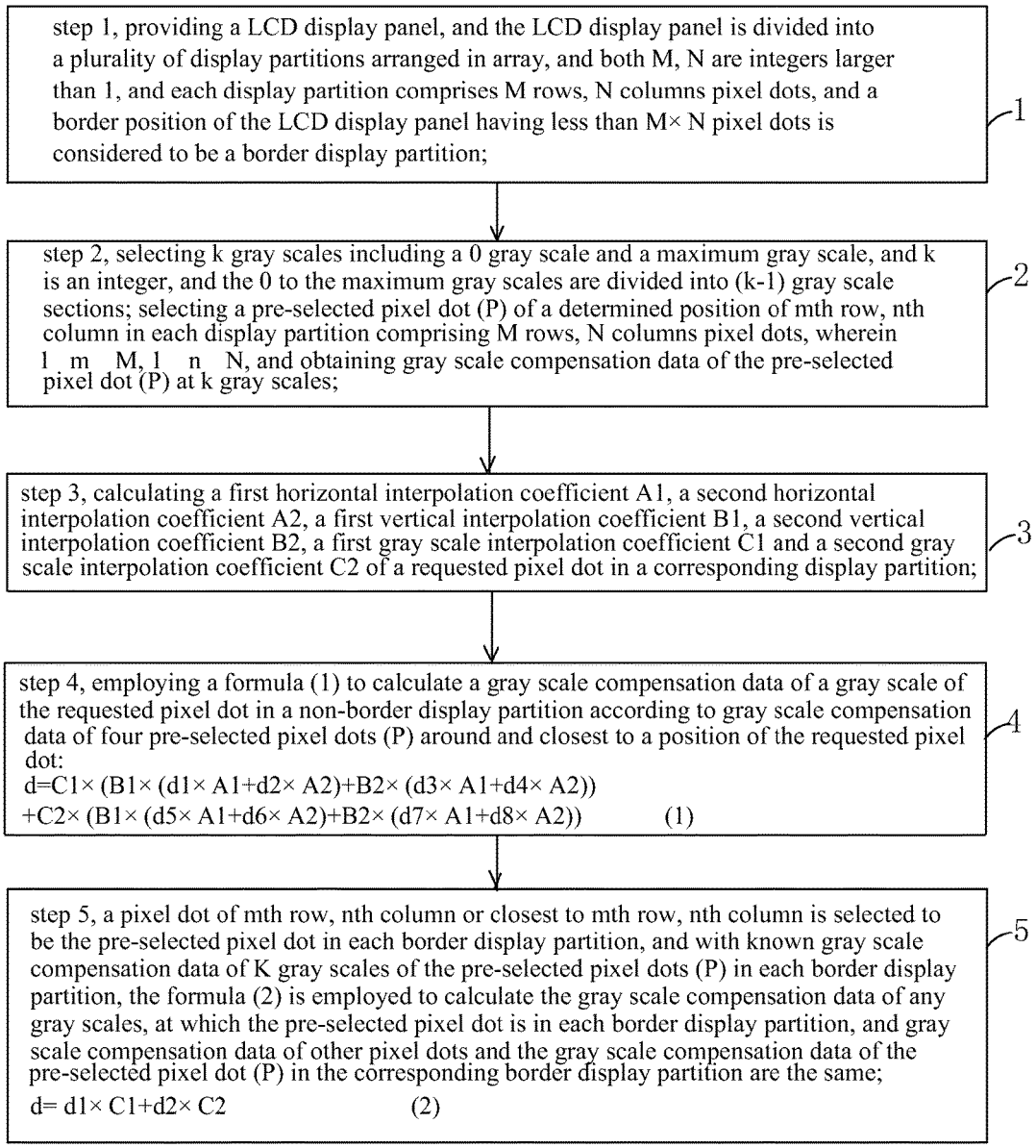
FIG. 1 is a flowchart of a compensation method of Mura phenomenon according to the present invention.
Figure 2:
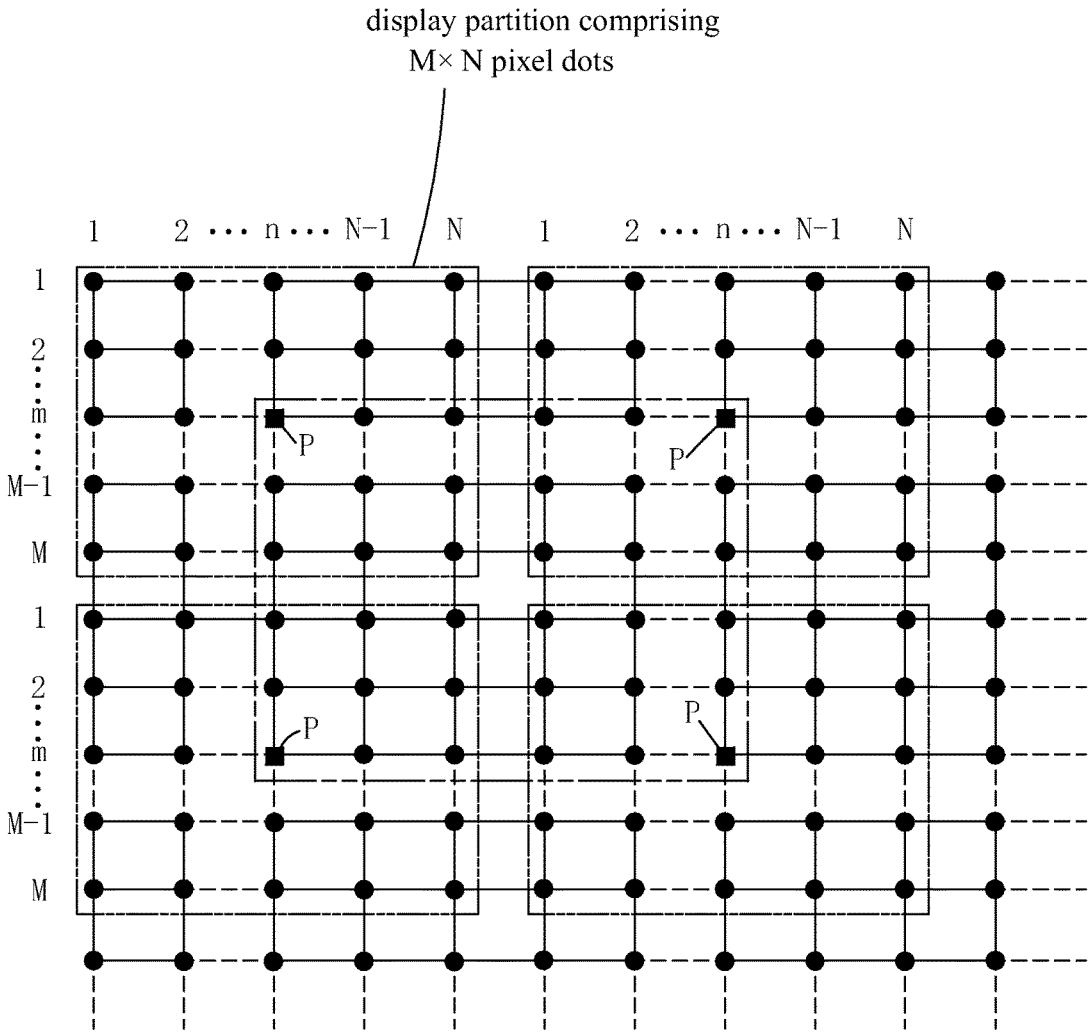
FIG. 2 is a diagram of the display partitions of dividing the display panel and the pre-selected pixel dots in the compensation method of Mura phenomenon according to the present invention.

Please refer to FIG. 1. The present invention provides a compensation method of Mura phenomenon, comprising steps of:

step 1, providing a LCD display panel having X×Y ($1<X\leq 8192$, $1<Y\leq 8192$) pixel dots, and as shown in FIG. 2, the LCD display panel is divided into a plurality of display partitions arranged in array, and both M, N are integers larger than 1, and each display partition comprises M rows, N columns pixel dots ($1<M\leq 8192$, $1<N\leq 8192$), and a border position of the LCD display panel having less than M×N pixel dots is considered to be a border display partition.

step 2, selecting k gray scales including a 0 gray scale and a maximum gray scale, and k is an integer, and the 0 to the maximum gray scales are divided into (k−1) gray scale sections, wherein $1<K\leq 999$, and for example, the preferable maximum gray scale is 255 gray scale, and the six gray scales, 0 gray scale, 16 gray scale, 32 gray scale, 64 gray scale, 128 gray scale and 255 gray scale are selected to divide the 0 to the 255 gray scales into five gray scale sections, which respectively are (0, 16), (16, 32), (32, 64), (64, 128), (128, 255); as shown in FIG. 2, selecting a pre-selected pixel dot P of a determined position of mth row, nth column in each display partition comprising M rows, N columns pixel dots, wherein $1\leq m\leq M$, $1\leq n\leq N$, and obtaining gray scale compensation data of the pre-selected pixel dot P at k gray scales, and preferably, the pre-selected pixel dot P of the determined position of first row, first column is selected in each display partition comprising M rows, N columns pixel dots.

Figure 3:
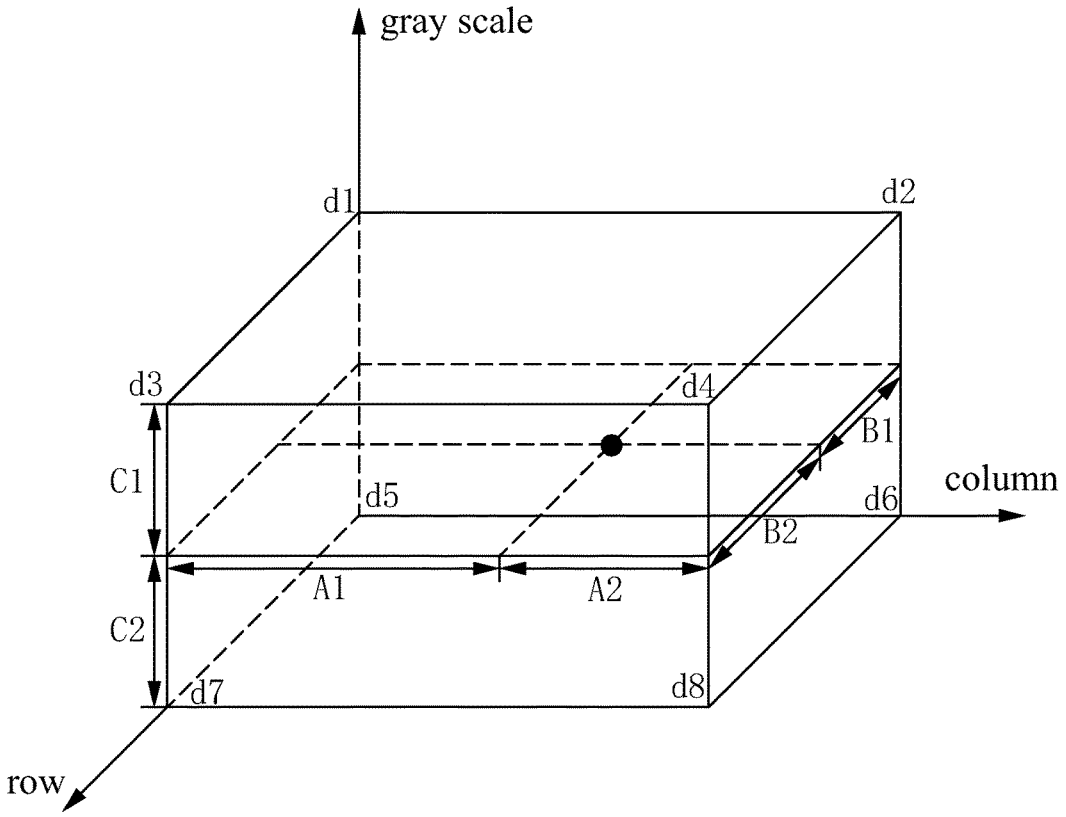
FIG. 3 is a relationship diagram of eight known gray scale compensation data and six interpolation coefficients of the requested pixel dots in the compensation method of Mura phenomenon according to the present invention.

Significantly, four memorizers provided in the step 2 respectively are a first memorizer, a second memorizer, a third memorizer and a fourth memorizer, and for the array comprising a plurality of pre-selected pixel dots P aligned in array, the first memorizer is employed to store the gray scale compensation data of the pre-selected pixel dots P of odd row, odd column at K gray scales, and the second memorizer is employed to store the gray scale compensation data of the pre-selected pixel dots P of odd row, even column at K gray scales, and the third memorizer is employed to store the gray scale compensation data of the pre-selected pixel dots P of even row, odd column at K gray scales, and the fourth memorizer is employed to store the gray scale compensation data of the pre-selected pixel dots P of even row, even column at K gray scales.

step 3, with combination of FIG. 2 and FIG. 3, calculating a first horizontal interpolation coefficient A1, a second horizontal interpolation coefficient A2, a first vertical interpolation coefficient B1, a second vertical interpolation coefficient B2, a first gray scale interpolation coefficient C1 and a second gray scale interpolation coefficient C2 of a requested pixel dot in a corresponding display partition.

In which, $0\leq A1\leq 1$; $0\leq A2\leq 1$; and $A1+A2=1$ for the same requested pixel dot; in one display partition comprising M rows, N columns pixel dots, for starting from a column where the pre-selected pixel dot P is in the display partition to the right in sequence, and reaching a right border of the display partition and turning to a left border, and keeping to the right until reaching a column adjacent to the column where the pre-selected pixel dot P is at the left side in sequence, the first horizontal gray scale interpolation coefficients A1 of the requested pixel dots of respective columns sequentially are N/N, N−1/N, . . . , 1/N, and the second horizontal gray scale interpolation coefficients A2 sequentially are 0/N, 1/N, . . . , N−1/N (if the column where the pre-selected pixel dot P is the left border, then the last column is the right border).

$0 \leq B1 \leq 1$, $0 \leq B2 \leq 1$; and $B1+B2=1$ for the same requested pixel dot; in one display partition comprising M rows, N columns pixel dots, for starting from a row where the pre-selected pixel dot is in the display partition to the bottom in sequence, and reaching a bottom border of the display partition and turning to a top border, and keeping to the bottom until reaching a row adjacent to the column where the pre-selected pixel dot is at the top side in sequence, the first vertical interpolation coefficient B1 of the requested pixel dots of respective rows sequentially are M/M, M−1/M, . . . , 1/M, and the second vertical interpolation coefficient B2 sequentially are 0/M, 1/M, . . . , M−1/M(if the row where the pre-selected pixel dot P is the top border, then the last row is the bottom border).

According to comparison of the grays scale compensation data of the requested pixel dot and the known K gray scales, the gray scale section of the gray scale of the request pixel dot is obtained; $0 \leq C1 \leq 1$, $0 \leq C2 \leq 1$; and $C1+C2=1$ for the same requested pixel dot; the first gray scale interpolation coefficient C1 is a ratio of a difference value of the gray scale of the requested pixel dot and the right border of the gray scale section and a length of an entire gray scale section, and the second gray scale interpolation coefficient C2 is a ratio of a difference value of the gray scale of the requested pixel dot and the left border of the gray scale section and the length of the entire gray scale section.

Figure 4:
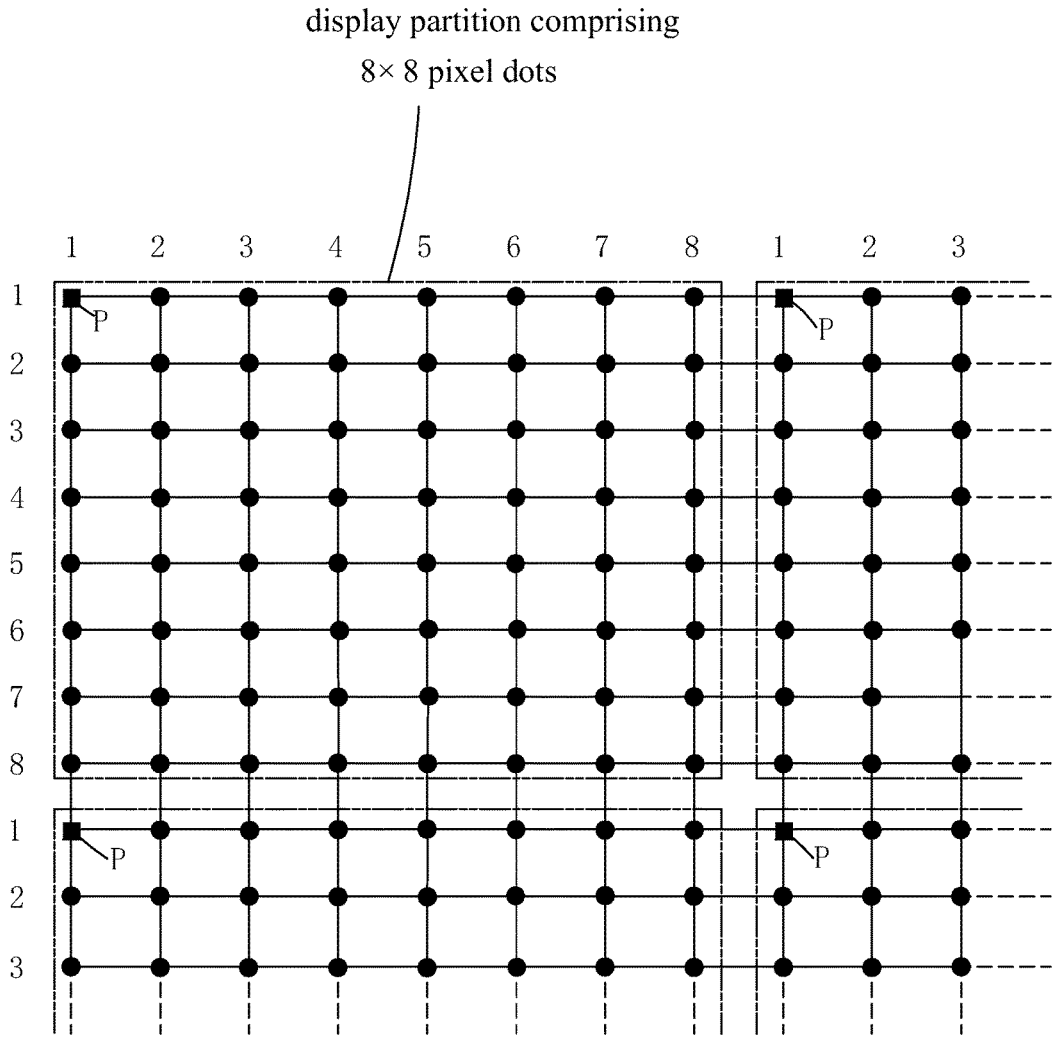
FIG. 4 is a diagram that a display partition comprising 8×8 pixel dots, and the pixel dot of first row, first column in the display partition is the pre-selected pixel dot in the compensation method of Mura phenomenon according to the present invention.

As shown in FIG. 4, the LCD display panel of resolution 1080×1920 is illustrated. The LCD display panel is divided into 135×240 display partitions, and each display partition comprises pixel dots of 8 rows, 8 columns. The K gray scales are 6 gray scales in total, 0 gray scale, 16 gray scale, 32 gray scale, 64 gray scale, 128 gray scale and 255 gray scale. The pixel dots of first row, first column in respective display partitions are selected to be the pre-selected pixel dot P. The bit depths of the first memorizer, the second memorizer, the third memorizer and the fourth memorizer are 48, which respectively and correspondingly store the gray scale compensation data of 8 bits of the 6 gray scales of the pre-selected pixel dots of odd row odd column, odd row even column, even row odd column and even row even column, and then:

As shown in FIG. 5, in respective display partitions, the first horizontal interpolation coefficients A1 of the requested pixel dots of the first to eighth columns from left to right, i.e. the first horizontal interpolation coefficient A1 of the eight requested pixel dots from left to right in each row are 8/8, 7/8, 6/8, 5/8, 4/8, 3/8, 2/8 and 1/8 in sequence. The second horizontal interpolation coefficient A2 corresponding thereto are 0/8, 1/8, 2/8, 3/8, 4/8, 5/8, 6/8 and 7/8.

As shown in FIG. 1, the first vertical interpolation coefficients B1 of the requested pixel dots of respective rows from top to bottom, i.e. the first vertical interpolation coefficients B1 of the eight requested pixel dots from top to bottom in each column are 8/8, 7/8, 6/8, 5/8, 4/8, 3/8, 2/8 and 1/8 in sequence. The second vertical interpolation coefficients B2 corresponding thereto are 0/8, 1/8, 2/8, 3/8, 4/8, 5/8, 6/8 and 7/8.

Figures 7, 8:
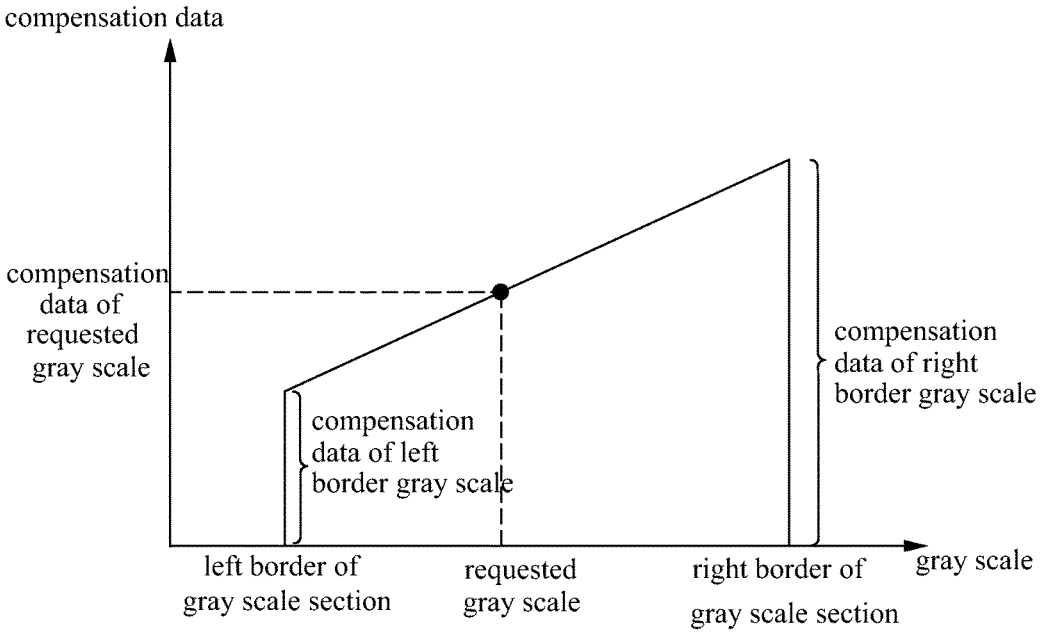
FIG. 7 is an illustration diagram of generation method of the first gray scale interpolation coefficient C1 and the second gray scale interpolation coefficient C2 in the compensation method of Mura phenomenon according to the present invention.
FIG. 8 is a relationship diagram of the gray scale compensation data of the requested gray scale of the pre-selected pixel dot and the gray scale compensation data of the border gray scale of the gray scale section where the pre-selected pixel dot is in the compensation method of Mura phenomenon according to the present invention.

It is illustrate that the maximum gray scale is 255 gray scale, and the six gray scales, 0 gray scale, 16 gray scale, 32 gray scale, 64 gray scale, 128 gray scale and 255 gray scale are selected to divide the 0 to the 255 gray scales into five gray scale sections, which respectively are (0, 16), (16, 32), (32, 64), (64, 128), (128, 255). The 8 bit binary number 10,000,000 is considered to be 1, and then as calculating the first gray scale interpolation coefficient C1 and the second gray scale interpolation coefficient C2: similarly, both the first gray scale interpolation coefficient C1 and the second gray scale interpolation coefficient C2 are set to be 8 bit binary numbers. The highest bit is the integer bit, and the other bits are the decimal bits. According to the 8 bits binary gray scale data signal inputted with the requested pixel dot, the gray scale section where the requested gray scale is can be determined. Specifically, if the highest bit of the 8 bits binary gray scale data signal inputted with the requested pixel dot is 1, then the requested gray scale is in the (128, 255) gray scale section, and when the inputted gray scale data is smaller than 11,000,000, the decimal bits of the first gray scale interpolation coefficient C1 are the lower seven bits of the inputted gray scale data signal, and the integer bit is 0, and when the inputted gray scale data is larger than 11,000,000, the decimal bits of the first gray scale interpolation coefficient C1 are the lower seven bits of the inputted gray scale data signal plus 1, and the integer bit is 0, and the second gray scale interpolation coefficient C2=10,000,000−C1; if the highest bit of the inputted gray scale data signal is 0 and the second highest bit is 1, then the requested gray scale is in the (64, 128) gray scale section, and the higher six decimal bits of the first gray scale interpolation coefficient C1 are the lower six bits of the inputted gray scale data signal, and other lower bits are filled with 0, and the integer bit is 0, and the second gray scale interpolation coefficient C2=10,000,000−C1; if the highest two bits of the inputted gray scale data signal are 0 and the third highest bit is 1, then the requested gray scale is in the (32, 64) gray scale section, and the higher five decimal bits of the first gray scale interpolation coefficient C1 are the lower five bits of the inputted gray scale data signal, and other lower bits are filled with 0, and the integer bit is 0, and the second gray scale interpolation coefficient C2=10,000,000−C1; if the highest three bits of the inputted gray scale data signal are 0 and the fourth highest bit is 1, then the requested gray scale is in the (16, 32) gray scale section, and the higher four decimal bits of the first gray scale interpolation coefficient C1 are the lower four bits of the inputted gray scale data signal, and other lower bits are filled with 0, and the integer bit is 0, and the second gray scale interpolation coefficient C2=10,000,000−C1; if the highest four bits of the inputted gray scale data signal are 0, then the requested gray scale is in the (0, 16) gray scale section, and the higher four decimal bits of the first gray scale interpolation coefficient C1 are the lower four bits of the inputted gray scale data signal, and other lower bits are filled with 0, and the integer bit is 0, and the second gray scale interpolation coefficient C2=10,000,000−C1. As shown in FIG. 7, the input gray scale data signal is set to be 00,101,011, and then the generated first gray scale interpolation coefficient C1 is 00,101,100, and the generated second gray scale interpolation coefficient C2 is 01,010,100.

step 4, calculating a gray scale compensation data d of a gray scale of the requested pixel dot in a non-border display partition with the formula (1) according to gray scale compensation data of four pre-selected pixel dots P around and closest to a position of the requested pixel dot:

$$d=C1\times(B1\times(d1\times A1+d2\times A2)+B2\times(d3\times A1+d4\times A2))+C2\times(B1\times(d5\times A1+d6\times A2)+B2\times(d7\times A1+d8\times A2)) \quad (1)$$

With combination of FIG. 2 and FIG. 3, d1 and d5 are gray scale compensation data of two border gray scales in the gray scale section of the gray scale of the request pixel dot, in which the pre-selected pixel dot P of a top left corner of a rectangle constructed by the four pre-selected pixel dots P around and closest to the position of the requested pixel dot is, and d2 and d6 are gray scale compensation data of two border gray scales in the gray scale section of the gray scale of the request pixel dot, in which the pre-selected pixel dot P of a top right corner of a rectangle constructed by the four pre-selected pixel dots P around and closest to the position of the requested pixel dot is, and d3 and d7 are gray scale compensation data of two border gray scales in the gray scale section of the gray scale of the request pixel dot, in which the pre-selected pixel dot P of a bottom left corner of a rectangle constructed by the four pre-selected pixel dots P around and closest to the position of the requested pixel dot is, and d4 and d8 are gray scale compensation data of two border gray scales in the gray scale section of the gray scale of the request pixel dot, in which the pre-selected pixel dot P of a bottom right corner of a rectangle constructed by the four pre-selected pixel dots P around and closest to the position of the requested pixel dot is.

Preferably, as shown in FIG. 2, FIG. 4, the four pre-selected pixel dots P around and closest to the position of the requested pixel dot respectively are the pre-selected pixel dot P in the display partition where the requested pixel is, the pre-selected pixel dot P in the display partition at the right and adjacent to the display partition where the requested pixel is, the pre-selected pixel dot P in the display partition at the bottom and adjacent to the display partition where the requested pixel is and the pre-selected pixel dot P in the display partition at the bottom right corner and adjacent to the display partition where the requested pixel is.

Particularly, as the requested pixel dot is the pre-selected pixel dot P, the gray scale compensation data d of the pre-selected pixel dot P at any gray scales is calculated according to formula (2):

$$d=d1\times C1+d2\times C2 \quad (2)$$

With combination of FIG. 2, FIG. 3 and FIG. 8, d1 is gray scale compensation data of a right border of a gray scale section, in which a requested gray scale of the pre-selected pixel dot, and d2 is gray scale compensation data of a left border of the gray scale section, in which the requested gray scale of the pre-selected pixel dot; the first gray scale interpolation coefficient C1 is a ratio of a difference value of the requested gray scale and the right border of the gray scale section and a length of an entire gray scale section, and the second gray scale interpolation coefficient C2 is a ratio of a difference value of the requested gray scale and the left border of the gray scale section and the length of the entire gray scale section.

Particularly, as the gray scale, at which the requested pixel dot is, is the one of the K gray scales, the gray scale compensation data d of the gray scale, at which the requested pixel dot is, can be calculated by formula (3):

$$d=(d1\times A1+d2\times A2)\times B1+(d3\times A1+d4\times A2)\times B2 \quad (3)$$

With combination of FIG. 2 and FIG. 3, d1 is gray scale compensation data of the gray scale of the request pixel dot, in which the pre-selected pixel dot P of a top left corner of a rectangle constructed by the four pre-selected pixel dots P around and closest to the position of the requested pixel dot is, and d2 is gray scale compensation data of the gray scale of the request pixel dot, in which the pre-selected pixel dot P of a top right corner of a rectangle constructed by the four pre-selected pixel dots P around and closest to the position of the requested pixel dot is, and d3 is gray scale compensation data of the gray scale of the request pixel dot, in which the pre-selected pixel dot P of a bottom left corner of a rectangle constructed by the four pre-selected pixel dots P around and closest to the position of the requested pixel dot is, and d4 is gray scale compensation data of the gray scale of the request pixel dot, in which the pre-selected pixel dot P of a bottom right corner of a rectangle constructed by the four pre-selected pixel dots around and closest to the position of the requested pixel dot is.

A1 is the first horizontal interpolation coefficient, and A2 is the second horizontal interpolation coefficient, and B1 is the first vertical interpolation coefficient, and B2 is the second vertical interpolation coefficient.

For the pixel dots in the border display partition, the border region may have less than M×N pixel dots, and the pre-selected pixel dots corresponding to four known gray scale compensation data may not exist. The formula (1) cannot be employed to calculate the gray scale compensation data. Therefore, the compensation method of Mura phenomenon according to the present invention further comprises:

step 5, a pixel dot of mth row, nth column or closest to mth row, nth column is selected to be the pre-selected pixel dot in each border display partition, and with known gray scale compensation data of K gray scales of the pre-selected pixel dots P in each border display partition, the formula (2) is employed to calculate the gray scale compensation data of any gray scales, at which the pre-selected pixel dot P is in each border display partition, and gray scale compensation data of other pixel dots and the gray scale compensation data of the pre-selected pixel dot P in the corresponding border display partition are the same:

$$d=d1\times C1+d2\times C2 \quad (2)$$

wherein d1 is gray scale compensation data of a right border of a gray scale section, in which a requested gray scale of the pre-selected pixel dot, and d2 is gray scale compensation data of a left border of the gray scale section, in which the requested gray scale of the pre-selected pixel dot; the first gray scale interpolation coefficient C1 is a ratio of a difference value of the requested gray scale and the right border of the gray scale section and a length of an entire gray scale section, and the second gray scale interpolation coefficient C2 is a ratio of a difference value of the requested gray scale and the left border of the gray scale section and the length of the entire gray scale section.

In the step 5, similarly, and preferably, the pixel dot of first row, first column is selected to be the pre-selected pixel dot P in each border display partition.

The benefits of the present invention are: the present invention provides a compensation method of Mura phenomenon. By dividing the LCD display panel into a plurality of display partitions, and selecting a pre-selected pixel dot of a determined position in each display partition and obtaining gray scale compensation data thereof at the respectively selected gray scales, and then, calculating the respective interpolation coefficients of the requested pixel dots in the corresponding display partitions, the compensation data of partial pixel dots in the respective gray scales and the respective interpolation coefficients of the requested pixel dots can be utilized to calculate the gray scale compensation data of all pixel dots in all gray scales. The calculation difficulty is reduced to lower the computation. The consumption of the hardware storage space is decreased, and the calculation of interpolation can ensure that the compensation data of each pixel dot and the actually required compensation data have little difference, which the human eyes cannot recognize. The Mura compensation result can be effectively improved. The time and effort can be saved and it can be simple and quick.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A compensation method of Mura phenomenon, comprising steps of:

step 1, providing a LCD display panel, and the LCD display panel is divided into a plurality of display partitions arranged in array, and both M, N are integers larger than 1, and each display partition comprises M rows, N columns pixel dots, and a border position of the LCD display panel having less than M×N pixel dots is considered to be a border display partition;

step 2, selecting k gray scales including a 0 gray scale and a maximum gray scale, and k is an integer, and the 0 to the maximum gray scales are divided into (k−1) gray scale sections; selecting a pre-selected pixel dot of a determined position of mth row, nth column in each display partition comprising M rows, N columns pixel dots, wherein 1≤m≤M, 1≤n≤N, and obtaining gray scale compensation data of the pre-selected pixel dot at k gray scales;

step 3, calculating a first horizontal interpolation coefficient A1, a second horizontal interpolation coefficient A2, a first vertical interpolation coefficient B1, a second vertical interpolation coefficient B2, a first gray scale interpolation coefficient C1 and a second gray scale interpolation coefficient C2 of a requested pixel dot in a corresponding display partition;

step 4, employing a formula (1) to calculate a gray scale compensation data d of a gray scale of the requested pixel dot in a non-border display partition according to gray scale compensation data of four pre-selected pixel dots around and closest to a position of the requested pixel dot:

$$d=C1\times(B1\times(d1\times A1+d2\times A2)+B2\times(d3\times A1+d4\times A2))+C2\times(B1\times(d5\times A1+d6\times A2)+B2\times(d7\times A1+d8\times A2)) \quad (1)$$

wherein d1 and d5 are gray scale compensation data of two border gray scales in the gray scale section of the gray scale of the request pixel dot, in which the pre-selected pixel dot of a top left corner of a rectangle constructed by the four pre-selected pixel dots around and closest to the position of the requested pixel dot is, and d2 and d6 are gray scale compensation data of two border gray scales in the gray scale section of the gray scale of the request pixel dot, in which the pre-selected pixel dot of a top right corner of a rectangle constructed by the four pre-selected pixel dots around and closest to the position of the requested pixel dot is, and d3 and d7 are gray scale compensation data of two border gray scales in the gray scale section of the gray scale of the request pixel dot, in which the pre-selected pixel dot of a bottom left corner of a rectangle constructed by the four pre-selected pixel dots around and closest to the position of the requested pixel dot is, and d4 and d8 are gray scale compensation data of two border gray scales in the gray scale section of the gray scale of the request pixel dot, in which the pre-selected pixel dot of a bottom right corner of a rectangle constructed by the four pre-selected pixel dots around and closest to the position of the requested pixel dot is.

2. The compensation method of Mura phenomenon according to claim 1, further comprising: step 5, a pixel dot of mth row, nth column or closest to mth row, nth column is selected to be the pre-selected pixel dot in each border display partition, and with known gray scale compensation data of K gray scales of the pre-selected pixel dots in each border display partition, the formula (2) is employed to calculate the gray scale compensation data of any gray scales, at which the pre-selected pixel dot is in each border display partition, and gray scale compensation data of other pixel dots and the gray scale compensation data of the pre-selected pixel dot in the corresponding border display partition are the same;

$$d=d1\times C1+d2\times C2 \quad (2)$$

wherein d1 is gray scale compensation data of a right border of a gray scale section, in which a requested gray scale of the pre-selected pixel dot, and d2 is gray scale compensation data of a left border of the gray scale section, in which the requested gray scale of the pre-selected pixel dot; the first gray scale interpolation coefficient C1 is a ratio of a difference value of the requested gray scale and the right border of the gray scale section and a length of an entire gray scale section, and the second gray scale interpolation coefficient C2 is a ratio of a difference value of the requested gray scale and the left border of the gray scale section and the length of the entire gray scale section.

3. The compensation method of Mura phenomenon according to claim 1, wherein in the step 3:

0≤A1≤1, 0≤A2≤1; and A1+A2=1 for the same requested pixel dot; in one display partition comprising M rows, N columns pixel dots, for starting from a column where the pre-selected pixel dot is in the display partition to the right in sequence, and reaching a right border of the display partition and turning to a left border, and keeping to the right until reaching a column adjacent to the column where the pre-selected pixel dot is at the left side in sequence, the first horizontal gray scale interpolation coefficients A1 of the requested pixel dots of respective columns sequentially are N/N, N−1/N, . . . , 1/N, and the second horizontal gray scale interpolation coefficients A2 sequentially are 0/N, 1/N, . . . , N−1/N;

0≤B1≤1, 0≤B2≤1; and B1+B2=1 for the same requested pixel dot; in one display partition comprising M rows, N columns pixel dots, for starting from a row where the pre-selected pixel dot is in the display partition to the bottom in sequence, and reaching a bottom border of the display partition and turning to a top border, and keeping to the bottom until reaching a row adjacent to the column where the pre-selected pixel dot is at the top side in sequence, the first vertical interpolation coefficient B1 of the requested pixel dots of respective rows sequentially are M/M, M−1/M, . . . , 1/M, and the second vertical interpolation coefficient B2 sequentially are 0/M, 1/M, . . . , M−1/M;

according to comparison of the grays scale compensation data of the requested pixel dot and the known K gray scales, the gray scale section of the gray scale of the request pixel dot is obtained; 0≤C1≤1, 0≤C2≤1; and C1+C2=1 for the same requested pixel dot; the first gray scale interpolation coefficient C1 is a ratio of a difference value of the gray scale of the requested pixel dot and the right border of the gray scale section and a length of an entire gray scale section, and the second gray scale interpolation coefficient C2 is a ratio of a difference value of the gray scale of the requested pixel dot and the left border of the gray scale section and the length of the entire gray scale section.

4. The compensation method of Mura phenomenon according to claim 1, wherein in the step 4, the four pre-selected pixel dots around and closest to the position of the requested pixel dot respectively are the pre-selected pixel dot in the display partition where the requested pixel is, the pre-selected pixel dot in the display partition at the right and adjacent to the display partition where the requested pixel is, the pre-selected pixel dot in the display partition at the bottom and adjacent to the display partition where the requested pixel is and the pre-selected pixel dot in the display partition at the bottom right corner and adjacent to the display partition where the requested pixel is.

5. The compensation method of Mura phenomenon according to claim 2, wherein in the step 2, the pre-selected pixel dot of the determined position of first row, first column is selected in each display partition comprising M rows, N columns pixel dots; in the step 5, the pixel dot of first row, first column is selected to be the pre-selected pixel dot in each border display partition.

6. The compensation method of Mura phenomenon according to claim 1, wherein four memorizers provided in the step 2 respectively are a first memorizer, a second memorizer, a third memorizer and a fourth memorizer, and for the array comprising a plurality of pre-selected pixel dots aligned in array, the first memorizer is employed to store the gray scale compensation data of the pre-selected pixel dots of odd row, odd column at K gray scales, and the second memorizer is employed to store the gray scale compensation data of the pre-selected pixel dots of odd row, even column at K gray scales, and the third memorizer is employed to store the gray scale compensation data of the pre-selected pixel dots of even row, odd column at K gray scales, and the fourth memorizer is employed to store the gray scale compensation data of the pre-selected pixel dots of even row, even column at K gray scales.

7. The compensation method of Mura phenomenon according to claim 1, wherein the maximum gray scale in the step 2 is 255 gray scale.

8. The compensation method of Mura phenomenon according to claim 1, wherein as the requested pixel dot is the pre-selected pixel dot, the gray scale compensation data d of the pre-selected pixel dot at any gray scales is calculated according to formula (2):

$$d=d1\times C1+d2\times C2 \quad (2)$$

wherein d1 is gray scale compensation data of a right border of a gray scale section, in which a requested gray scale of the pre-selected pixel dot, and d2 is gray scale compensation data of a left border of the gray scale section, in which the requested gray scale of the pre-selected pixel dot; the first gray scale interpolation coefficient C1 is a ratio of a difference value of the requested gray scale and the right border of the gray scale section and a length of an entire gray scale section, and the second gray scale interpolation coefficient C2 is a ratio of a difference value of the requested gray scale and the left border of the gray scale section and the length of the entire gray scale section.

9. The compensation method of Mura phenomenon according to claim 1, wherein as the gray scale, at which the requested pixel dot is, is the one of the K gray scales, the gray scale compensation data d of the gray scale, at which the requested pixel dot is, is calculated by formula (3):

$$d=(d1\times A1+d2\times A2)\times B1+(d3\times A1+d4\times A2)\times B2 \quad (3)$$

d1 is gray scale compensation data of the gray scale of the request pixel dot, in which the pre-selected pixel dot of a top left corner of a rectangle constructed by the four pre-selected pixel dots around and closest to the position of the requested pixel dot is, and d2 is gray scale compensation data of the gray scale of the request pixel dot, in which the pre-selected pixel dot of a top right corner of a rectangle constructed by the four pre-selected pixel dots around and closest to the position of the requested pixel dot is, and d3 is gray scale compensation data of the gray scale of the request pixel dot, in which the pre-selected pixel dot of a bottom left corner of a rectangle constructed by the four pre-selected pixel dots around and closest to the position of the requested pixel dot is, and d4 is gray scale compensation data of the gray scale of the request pixel dot, in which the pre-selected pixel dot of a bottom right corner of a rectangle constructed by the four pre-selected pixel dots around and closest to the position of the requested pixel dot is.

10. A compensation method of Mura phenomenon, comprising steps of:

step 1, providing a LCD display panel, and the LCD display panel is divided into a plurality of display partitions arranged in array, and both M, N are integers larger than 1, and each display partition comprises M rows, N columns pixel dots, and a border position of the LCD display panel having less than M×N pixel dots is considered to be a border display partition;

step 2, selecting k gray scales including a 0 gray scale and a maximum gray scale, and k is an integer, and the 0 to the maximum gray scales are divided into (k−1) gray scale sections; selecting a pre-selected pixel dot of a determined position of mth row, nth column in each display partition comprising M rows, N columns pixel dots, wherein $1\leq m\leq M$, $1\leq n\leq N$, and obtaining gray scale compensation data of the pre-selected pixel dot at k gray scales;

step 3, calculating a first horizontal interpolation coefficient A1, a second horizontal interpolation coefficient A2, a first vertical interpolation coefficient B1, a second vertical interpolation coefficient B2, a first gray scale interpolation coefficient C1 and a second gray scale interpolation coefficient C2 of a requested pixel dot in a corresponding display partition;

step 4, employing a formula (1) to calculate a gray scale compensation data d of a gray scale of the requested pixel dot in a non-border display partition according to gray scale compensation data of four pre-selected pixel dots around and closest to a position of the requested pixel dot:

$$d=C1\times(B1\times(d1\times A1+d2\times A2)+B2\times(d3\times A1+d4\times A2))+C2\times(B1\times(d5\times A1+d6\times A2)+B2\times(d7\times A1+d8\times A2)) \quad (1)$$

wherein d1 and d5 are gray scale compensation data of two border gray scales in the gray scale section of the gray scale of the request pixel dot, in which the pre-selected pixel dot of a top left corner of a rectangle constructed by the four pre-selected pixel dots around and closest to the position of the requested pixel dot is, and d2 and d6 are gray scale compensation data of two border gray scales in the gray scale section of the gray scale of the request pixel dot, in which the pre-selected pixel dot of a top right corner of a rectangle constructed by the four pre-selected pixel dots around and closest to the position of the requested pixel dot is, and d3 and d7 are gray scale compensation data of two border gray scales in the gray scale section of the gray scale of the request pixel dot, in which the pre-selected pixel dot of a bottom left corner of a rectangle constructed by the four pre-selected pixel dots around and closest to the position of the requested pixel dot is, and d4 and d8 are gray scale compensation data of two border gray scales in the gray scale section of the gray scale of the request pixel dot, in which the pre-selected pixel dot of a bottom right corner of a rectangle constructed by the four pre-selected pixel dots around and closest to the position of the requested pixel dot is;

the compensation method further comprises: step 5, a pixel dot of mth row, nth column or closest to mth row, nth column is selected to be the pre-selected pixel dot in each border display partition, and with known gray scale compensation data of K gray scales of the pre-selected pixel dots in each border display partition, the formula (2) is employed to calculate the gray scale compensation data of any gray scales, at which the pre-selected pixel dot is in each border display partition, and gray scale compensation data of other pixel dots and the gray scale compensation data of the pre-selected pixel dot in the corresponding border display partition are the same;

$$d=d1\times C1+d2\times C2 \quad (2)$$

wherein d1 is gray scale compensation data of a right border of a gray scale section, in which a requested gray scale of the pre-selected pixel dot, and d2 is gray scale compensation data of a left border of the gray scale section, in which the requested gray scale of the pre-selected pixel dot; the first gray scale interpolation coefficient C1 is a ratio of a difference value of the requested gray scale and the right border of the gray scale section and a length of an entire gray scale section, and the second gray scale interpolation coefficient C2 is a ratio of a difference value of the requested gray scale and the left border of the gray scale section and the length of the entire gray scale section;

wherein in the step 3:

$0\leq A1\leq 1$, $0\leq A2\leq 1$; and $A1+A2=1$ for the same requested pixel dot; in one display partition comprising M rows, N columns pixel dots, for starting from a column where the pre-selected pixel dot is in the display partition to the right in sequence, and reaching a right border of the display partition and turning to a left border, and keeping to the right until reaching a column adjacent to the column where the pre-selected pixel dot is at the left side in sequence, the first horizontal gray scale interpolation coefficients A1 of the requested pixel dots of respective columns sequentially are N/N, N−1/N, . . . , 1/N, and the second horizontal gray scale interpolation coefficients A2 sequentially are 0/N, 1/N, . . . , N−1/N;

$0\leq B1\leq 1$, $0\leq B2\leq 1$; and $B1+B2=1$ for the same requested pixel dot; in one display partition comprising M rows, N columns pixel dots, for starting from a row where the pre-selected pixel dot is in the display partition to the bottom in sequence, and reaching a bottom border of the display partition and turning to a top border, and keeping to the bottom until reaching a row adjacent to the column where the pre-selected pixel dot is at the top side in sequence, the first vertical interpolation coefficient B1 of the requested pixel dots of respective rows sequentially are M/M, M−1/M, . . . , 1/M, and the second vertical interpolation coefficient B2 sequentially are 0/M, 1/M, . . . , M−1/M;

according to comparison of the grays scale compensation data of the requested pixel dot and the known K gray scales, the gray scale section of the gray scale of the request pixel dot is obtained; $0\leq C1\leq 1$, $0\leq C2\leq 1$; and $C1+C2=1$ for the same requested pixel dot; the first gray scale interpolation coefficient C1 is a ratio of a difference value of the gray scale of the requested pixel dot and the right border of the gray scale section and a length of an entire gray scale section, and the second gray scale interpolation coefficient C2 is a ratio of a difference value of the gray scale of the requested pixel dot and the left border of the gray scale section and the length of the entire gray scale section;

wherein in the step 4, the four pre-selected pixel dots around and closest to the position of the requested pixel dot respectively are the pre-selected pixel dot in the display partition where the requested pixel is, the pre-selected pixel dot in the display partition at the right and adjacent to the display partition where the requested pixel is, the pre-selected pixel dot in the display partition at the bottom and adjacent to the display partition where the requested pixel is and the pre-selected pixel dot in the display partition at the bottom right corner and adjacent to the display partition where the requested pixel is.

11. The compensation method of Mura phenomenon according to claim 10, wherein in the step 2, the pre-selected pixel dot of the determined position of first row, first column is selected in each display partition comprising M rows, N columns pixel dots; in the step 5, the pixel dot of first row, first column is selected to be the pre-selected pixel dot in each border display partition.

12. The compensation method of Mura phenomenon according to claim 10, wherein four memorizers provided in the step 2 respectively are a first memorizer, a second memorizer, a third memorizer and a fourth memorizer, and for the array comprising a plurality of pre-selected pixel dots aligned in array, the first memorizer is employed to store the gray scale compensation data of the pre-selected pixel dots of odd row, odd column at K gray scales, and the second memorizer is employed to store the gray scale compensation data of the pre-selected pixel dots of odd row, even column at K gray scales, and the third memorizer is employed to store the gray scale compensation data of the pre-selected pixel dots of even row, odd column at K gray scales, and the fourth memorizer is employed to store the gray scale compensation data of the pre-selected pixel dots of even row, even column at K gray scales.

13. The compensation method of Mura phenomenon according to claim 10, wherein the maximum gray scale in the step 2 is 255 gray scale.

14. The compensation method of Mura phenomenon according to claim 10, wherein as the requested pixel dot is the pre-selected pixel dot, the gray scale compensation data d of the pre-selected pixel dot at any gray scales is calculated according to formula (2):

$$d=d1\times C1+d2\times C2 \quad (2)$$

wherein d1 is gray scale compensation data of a right border of a gray scale section, in which a requested gray scale of the pre-selected pixel dot, and d2 is gray scale compensation data of a left border of the gray scale section, in which the requested gray scale of the pre-selected pixel dot; the first gray scale interpolation coefficient C1 is a ratio of a difference value of the requested gray scale and the right border of the gray scale section and a length of an entire gray scale section, and the second gray scale interpolation coefficient C2 is a ratio of a difference value of the requested gray scale and the left border of the gray scale section and the length of the entire gray scale section.

15. The compensation method of Mura phenomenon according to claim 10, wherein as the gray scale, at which the requested pixel dot is, is the one of the K gray scales, the gray scale compensation data d of the gray scale, at which the requested pixel dot is, is calculated by formula (3):

$$d=(d1\times A1+d2\times A2)\times B1+(d3\times A1+d4\times A2)\times B2 \quad (3)$$

d1 is gray scale compensation data of the gray scale of the request pixel dot, in which the pre-selected pixel dot of a top left corner of a rectangle constructed by the four pre-selected pixel dots around and closest to the position of the requested pixel dot is, and d2 is gray scale compensation data of the gray scale of the request pixel dot, in which the pre-selected pixel dot of a top right corner of a rectangle constructed by the four pre-selected pixel dots around and closest to the position of the requested pixel dot is, and d3 is gray scale compensation data of the gray scale of the request pixel dot, in which the pre-selected pixel dot of a bottom left corner of a rectangle constructed by the four pre-selected pixel dots around and closest to the position of the requested pixel dot is, and d4 is gray scale compensation data of the gray scale of the request pixel dot, in which the pre-selected pixel dot of a bottom right corner of a rectangle constructed by the four pre-selected pixel dots around and closest to the position of the requested pixel dot is.

* * * * *